United States Patent [19]

Jamieson et al.

[11] Patent Number: 4,502,800

[45] Date of Patent: Mar. 5, 1985

[54] DAISYWHEEL PRINTER

[75] Inventors: John W. Jamieson, Alamo; Sen L. Lee; Suhdok D. Moon, both of Los Altos, all of Calif.

[73] Assignee: 501 Qume Corporation, San Jose, Calif.

[21] Appl. No.: 396,243

[22] Filed: Jul. 8, 1982

[51] Int. Cl.[3] ..... B41J 1/30

[52] U.S. Cl. ..... 400/144.2; 400/320; 400/322

[58] Field of Search ..... 400/144.2, 144.3, 154.1, 400/154.4, 320, 322; 101/93.19

[56] References Cited

U.S. PATENT DOCUMENTS

| | | | |
|---|---|---|---|
| 3,954,163 | 5/1976 | Gabor | 101/93.19 X |
| 4,010,835 | 3/1977 | Martin et al. | 400/124 |
| 4,044,880 | 8/1977 | Martin | 400/82 X |

*Primary Examiner*—Paul T. Sewell

*Attorney, Agent, or Firm*—T. L. Peterson; J. M. May

[57] ABSTRACT

A printer having a print wheel rotatable on a carriage. The carriage is guided for movement parallel to a platen. The printer may print at either a fast speed for draft quality output, or a slower speed for highest quality output. The lesser quality of output produced at the fast speed is more than adequate for draft documents.

6 Claims, 3 Drawing Figures

DAISYWHEEL PRINTER

BACKGROUND OF THE INVENTION

This invention relates to high speed printers, and more particularly to a daisywheel printer or the like.

PRIOR ART STATEMENT

Daisywheel printers, broadly speaking, are known in the art. Some are disclosed in the following:
Robinson U.S. Pat. No. 3,356,199
Staller U.S. Pat. No. 3,371,766
Tramposch et al. U.S. Pat. No. 3,817,367
Castoldi et al. U.S. Pat. No. 3,884,339
Beattie U.S. Pat. No. 3,908,809
Martin U.S. Pat. No. 4,044,880
Jensen et al. U.S. Pat. No. 4,101,006
Kane U.S. Pat. No. 4,178,108
Kane et al. U.S. Pat. No. 4,189,246.

See Robinson, column 1, lines 43–48.
See Staller, column 3, line 67 et seq.
See the abstract of Tramposch et al.
See Castoldi et al. column 1, line 9, "on-the-fly."
See Beattie "lag times" in the abstract. In Beattie, see also column 1, lines 38–41. Column 2, lines 4–31 read:

"With these handicaps of the prior art recognized, it then becomes an object of this invention to increase the speed of printing using a serial impact printer with the existing printer discs speeds by eliminating the starting and stopping of the disc and the carrier and superimposing upon the movements of the carrier, a second movement to accurately position the print point at any one time, depending upon the distance and time separating the successive characters.

"Another object of this invention is to increase the speed of printing using a serial impact printer of the rotating disc type, using existing printer technology, by duplication of the character set to reduce the amount of time between successive characters.

"SUMMARY OF THE INVENTION

"The foregoing objects are accomplished and the handicaps of the prior art are overcome by superimposing on the movement of the disc carrier, a second motion or corrective displacement. This is accomplished by the utilization of a knowledge of the distance between characters on the print wheel and determination of the amount of time necessary to rotate the print wheel from a first position to a second position and the conversion of that time factor into a distance which the print wheel carrier will traverse at constant velocity during that time."

In Martin, see column 2, lines 12–13, 40–41, 43–47, 55–56: " . . . the velocity of the carrier is reduced to zero, i.e., stopped, for various intervals when the set-up time of the print mechanism to set up to print the next character exceeds the normal traverse time between adjacent print positions."

In the abstract of Jensen et al. the following is found:

"The carrier for the type element is moved along the print line at a predetermined maximum velocity so long as it is possible to move the type element to the next character in time required to move the carrier from one print position to the next. If the type character set-up time is greater, the carrier is run at a slower speed and is then returned to the predetermined velocity for printing."

The following is the entire abstract of Kane:

"A rotatable print disk is mounted on a carrier which traverses along the print line. The disk is moved from each character position to the next by the shortest distance at a constant velocity; thus, the time for the disk to move from a given character position to the next will be variable dependent on this distance. The carrier is moved from one print position to the next, a fixed distance, at a variable speed selected in order that carrier reach the next print position in synchronization with the disk reaching the next character position. Upon such synchronization, a print hammer is fired to print the character while the carriage continues on-the-fly towards the next print position. The apparatus includes means responsive to a synchronization failure for reversing the movement of the carrier towards the previous printing position while permitting the continued movement of the print disk to the next character position, and means for then reinitiating the forward movement of the carrier towards the next print position while retaining the print disk at said next character position until the arrival of the reinitiated carrier at the next print position."

The following is the entire abstract of Kane et al.:

"A rotatable print disc is mounted on a carrier which traverses along the print line. The disk is moved from each character position to the next by the shortest distance and it is stopped at the time of printing. The carrier is moved from one print position to the next at a speed which is selected depending on the time required for the disk to rotate to the next character. Printing takes place with the carrier moving at one of a number of speeds. The force utilized to drive the hammer to print the characters is varied dependent on which character is being printed. Hammer firing for each character is timed dependent on printing speed and upon the force utilized to drive the hammer."

The present invention relates to a fully formed character inpact printer, e.g., of the daisywheel type, capable of selective operation in either a high speed draft quality mode or a lower speed letter quality mode.

In accordance with the preferred embodiment, in the lower speed letter quality mode (e.g., 55 characters per second) both the print element velocity and the carriage velocity are reduced to zero prior to printing each character. In the high speed draft quality mode (e.g., 95 CPS), only the print element velocity is brought to zero. The carriage velocity is maintained and printing occurs "on the fly" except in those situations where the print element is unable to move the next character into print position by the time the carriage arrives at the column (character position) to be printed. In such situations, the carriage velocity is reduced to zero to await the positioning of the print element.

BRIEF DESCRIPTION OF THE DRAWINGS

In the accompanying drawings which illustrate an exemplary embodiment of the present invention.

DESCRIPTION OF THE PREFERRED EMBODIMENT

Figures 1, 2:
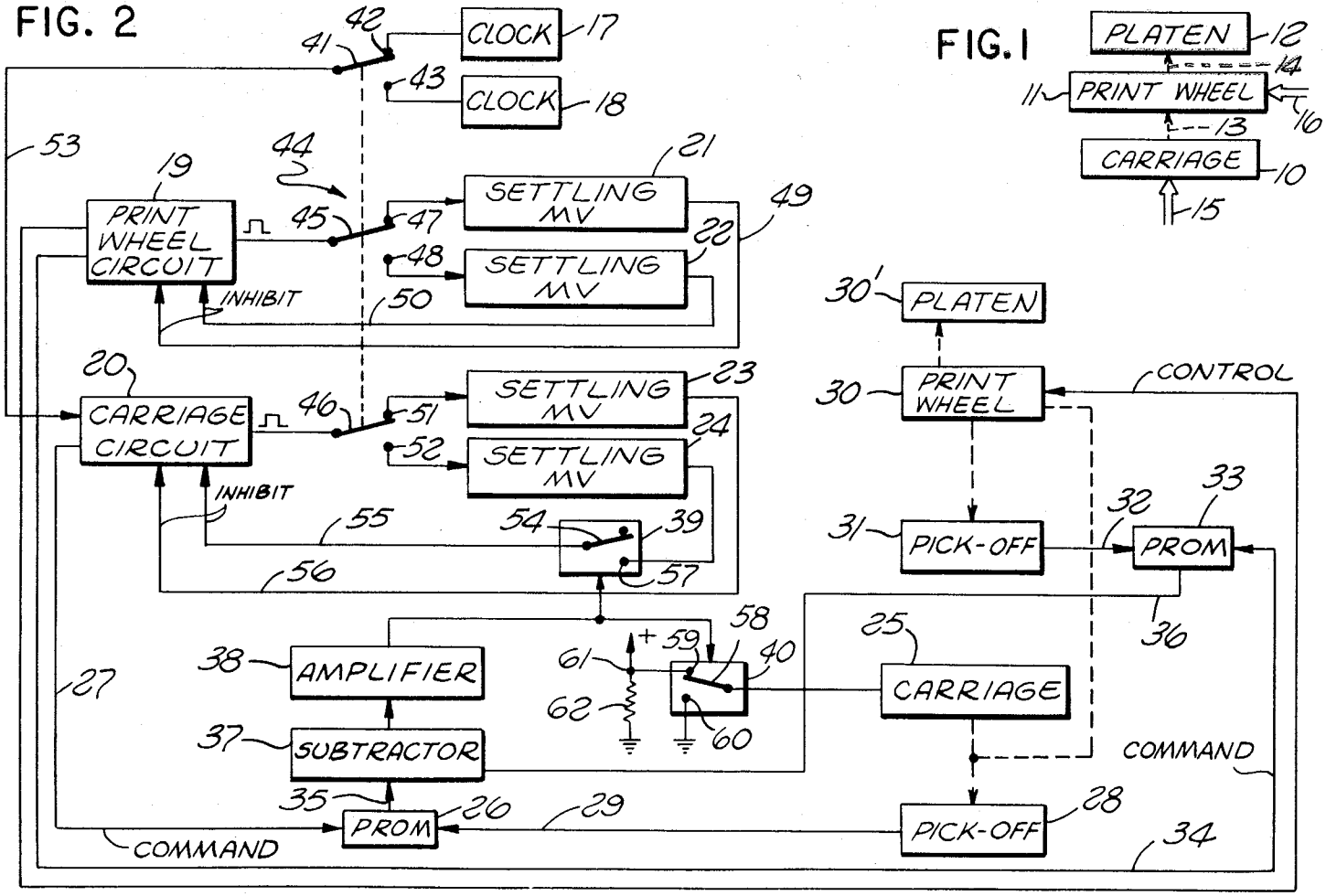
FIG. 1 is a block diagram of a portion of the printer of the present invention.
FIG. 2 is a detailed block diagram of the printer of the present invention.

In FIG. 1 of the drawing, a carriage 10 moves a print wheel 11 along a platen 12. In the manner commonly shown, mechanical connections are provided at 13 and 14, and electrical leads are provided at 15 and 16.

Print wheel 11 includes a conventional daisywheel with petals having integral or other type fonts thereon to be pressed against an inked ribbon and paper on the platen 12. Everything shown in FIG. 1 may be conventional, if desired. Furthermore, the structures shown in FIG. 1 may form a portion of the present invention.

In FIG. 2, two clocks 17 and 18 are provided (frequencies 55 Hz and 75–95 Hz, respectively, for example) with a print wheel circuit 19 and a carriage circuit 20. Timing circuits, preferably one shots (multivibrators) are provided at 21, 22, 23 and 24. Circuits 21, 22 respectively define long and short settling time durations for print wheel circuit 19. Circuits 23, 24 respectively define long and short settling time durations for carriage circuit 20.

A carriage is provided at 25. A PROM 26 is also provided. Carriage circuit 20 provides a command signal over a lead 27 to PROM 26. The signal on lead 27 defines a magnitude of the next character position to be printed. A pick-off 28 is connected from carriage 25 and provides a signal on an output lead 29 to PROM 26 indicative of the actual position of carriage 25.

A print wheel is provided at 30 in FIG. 2 having a pick-off 31 providing an output signal on a lead 32 indicative of the print wheel angular position. The signal on lead 32 is impressed upon a PROM 33. PROM 33 also has an input lead 34 connected from print wheel circuit 19. Lead 34 carries a command signal which determines the next succeeding character to be printed.

The command signal on line 27 and the actual character position signal on line 29, in combination, address PROM 26 to access information therefrom indicating the time required for the carriage to reach its destination position.

Similarly, the command signal on line 34 and the actual print wheel position signal on line 32, in combination, address PROM 33 to access information therefrom indicating the time required for the print wheel to reach its destination position.

Subtractor 37 compares the outputs of PROMs 26 and 33 to determine whether the print wheel will be able to move the selected character into print position by the time the carriage reaches its destination position. If the selected character will arrive in time, then the carriage velocity is not interrupted. However, if the print wheel is unable to reach its destination by the time the carriage arrives at its destination position, then the carriage velocity is interrupted, preferably by reducing its velocity to zero. Carriage velocity interruption occurs as a consequence of the amplifier 38 responding to the output of subtractor 37 to move switches 39 and 40 from their positions shown in FIG. 2, as will be described more fully hereinafter.

One of the clocks 17 and 18 is connected to carriage circuit 20 via a pole 41 and two contacts 42 and 43 engageable thereby. Pole 41 is a part of a triple-pole, double-throw toggle switch 44.

Switch 44 has ganged poles 41, 45 and 46. Contacts 42 and 43 are connected from clocks 17 and 18, respectively. Contacts 47 and 48, engageable by pole 45, are connected to multivibrator (MV) 21 and MV 22, respectively. MV 21 and MV 22 have output leads 49 and 50 connected to print wheel circuit 19. Contacts 51 and 52, engageable by pole 46, are connected to MV 23 and MV 24, respectively. Pole 41 is connected to input lead 53 of circuit 20. Poles 45 and 46 are connected from circuits 19 and 20, respectively.

Switch 39 is a single-pole, double-throw electronic switch having a pole 54 connected to an input lead 55 of circuit 20. Circuit 20 has an input lead 56 which is also the output lead of MV 23.

Switch 39 effectively has a contact 57 connected from the output of MV 24.

Switch 40 is an electronic single-pole, double-throw switch that has a pole 58 connected to a conventional velocity servo in carriage 25. There is a constant high potential connected to a contact 59 and a zero or ground potential connected to a contact 60. A positive source of potential is connected from a junction 61. A resistor 62 is connected from junction 61 to ground.

OPERATION

The embodiment of the present invention shown in FIG. 2 has a platen 30'.

When switch 44 is in the position shown, the carriage and print wheel are driven at a slower speed by clock 17. The long settling times for the print wheel 30 and carriage 25 are established by MV 21 and MV 23, respectively.

During the time that switch 44 is in the position shown, print wheel 30 and carriage 25 operate conventionally and independently of the potential of switch pole 58.

When switch 44 is moved to the position not shown, MV 22 provides a more limited settling time for print wheel 30. MV 24 provides no settling time at all for carriage 25, therefore, the carriage does not stop, and printing occurs while the carriage continues to move; this takes place so long as print wheel 30 will reach the next character before carriage 25 will reach its next character position. Switch 39 is thus then in the position shown as is switch 40.

If carriage 25 will not reach its next position on or after the time that the print wheel 30 will reach its next position, amplifier 38 causes switches 39 and 40 to switch from the positions shown, carriage 25 is given settling time, and the velocity of carriage 25 will be reduced to zero (pole 58 is grounded), thus the carriage will stop to wait for the print wheel to arrive at its destination for printing.

If desired, the output of subtractor 37 may be equal to the difference between the magnitudes of the signals on leads 27 and 29 minus the difference between the magnitudes of the signals on leads 34 and 32. Amplifier 38 may have a fairly high gain so that switches 39 and 40 may be actuated or deactuated when the output of the amplifier 38 is $V \pm \Delta$, in volts, where $$\left|\frac{\Delta}{V}\right| << 1,$$

for example.

SUMMARY

High quality printing can be achieved at 55 characters per second and draft quality printing can be achieved in the area of 75 to 95 characters per second. Selection of draft printing or high quality printing may be accomplished by manually actuating switch 44 or electronically activating same through the interface lines to the printer.

Prior art printers stop both the daisywheel and the carriage prior to striking each character. These stops each have associated settling times. The printer of the present invention, while in draft mode, always brings the print wheel to a stop. However, settling time associated with the print wheel is reduced to a minimum to achieve maximum speed. This reduction of settling time will result in a slight reduction in positional accuracy.

The carriage in the instant printer only decelerates and stops if the print wheel is unable to reach its destination prior to the carriage reaching the next column requiring hammer firing. In other words, the carriage only stops when the next character is going to be print wheel limited. In addition, settling time for the carriage is reduced to a minimum to further increase speed while in the draft mode. The first character of every word is printed without the carriage decelerating and stopping because the print wheel then has ample time to come to a stop and to settle. In addition, many of the letters within a word are printed without the carriage stopping. The horizontal registration is less accurate than that of prior art printers because of the continued movement of the carriage while printing some characters and the minimization of settling times for both the print wheel and the carriage; however, the quality is very good and more than adequate for draft quality printing.

One hammer intensity preferably should be utilized during draft mode printing so that settling times can be further minimized. This is true because rebound times are more nearly constant.

Figure 3:
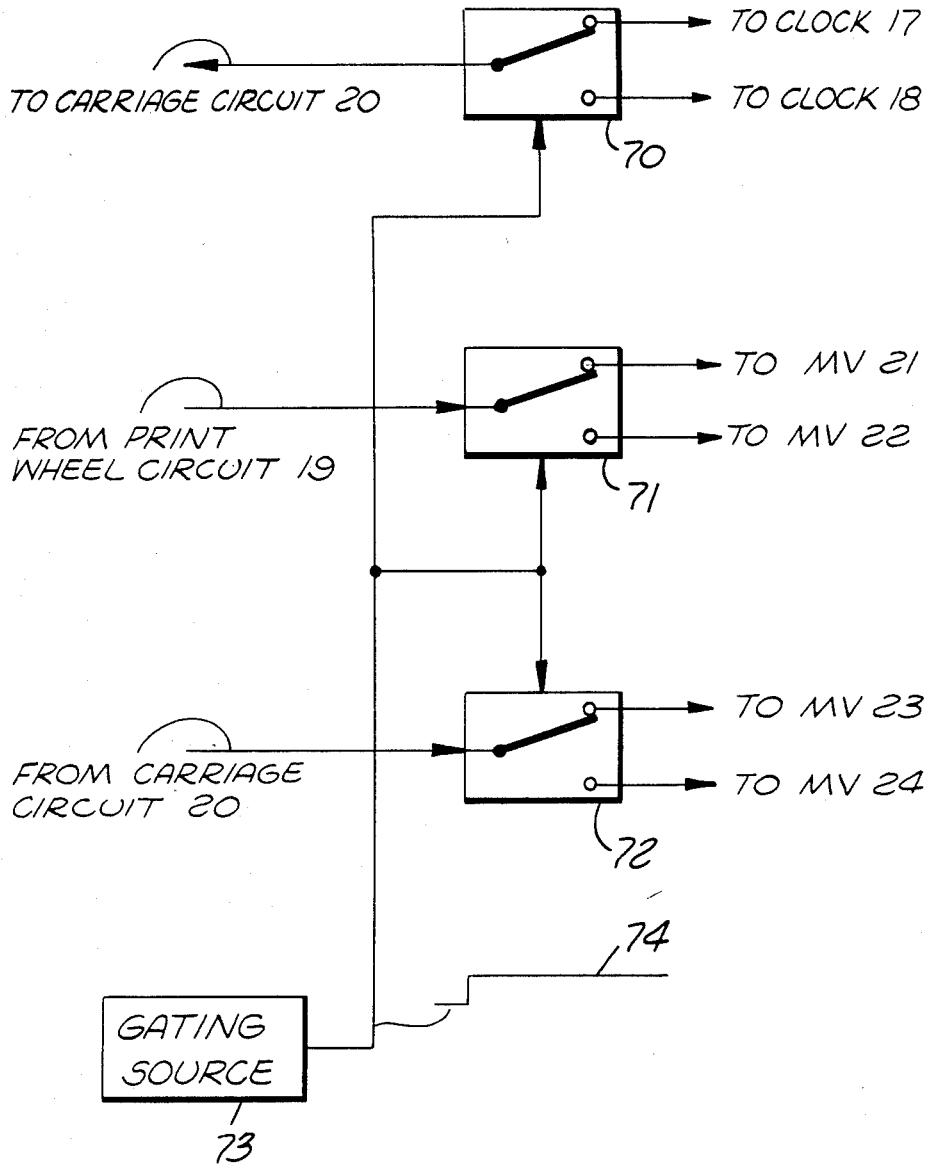
FIG. 3 is a diagrammatic view of an electronic equivalent of a triple-pole, double-throw toggle switch shown in FIG. 2.

An alternative to switch 44 is shown in FIG. 3 including electronic switches 70, 71 and 72 operated simultaneously by a gating source 73 having an output voltage which is a step function. See waveform 74. Gating source 73 may be any conventional gating source.

What is claimed is:

1. A printer comprising:

a platen;

carriage means mounted for movement parallel to said platen along a line comprised of multiple character positions;

a hammer carried by said carriage means selectively actuatable for movement toward said platen;

print wheel means carrying a plurality of fully formed characters;

means mounting said print wheel means on said carriage means for movement with respect to said hammer whereby each of said plurality of characters can be moved into a print position in alignment with said hammer;

carriage control means selectively operable in either a high speed mode for continually moving said carriage means along said line or a lower speed mode for moving said carriage means along said line in steps, stopping at each character position to be printed;

print wheel control means for moving and stopping said print wheel means to move a selected one of said characters into said print position and stop thereat for a defined print wheel settling duration prior to said carriage means arriving at each character position to be printed;

carriage interrupt means operable during said high speed mode for stopping the movement of said carriage means at a character position in the event the selected character for that character position fails to move into and stop at said print position by the time said carriage means arrives at that character position; and timing circuit means coupled to said print wheel control means for defining intervals of longer and shorter print wheel settling durations associated respectively with said low speed mode and with said high speed mode.

2. A printer comprising:

a platen;

carriage means mounted for movement parallel to said platen along a line comprised of multiple character positions;

a hammer carried by said carriage means selectively actuatable for movement toward said platen;

print wheel means carrying a plurality of fully formed characters;

means mounting said print wheel means on said carriage means for movement with respect to said hammer whereby each of said plurality of characters can be moved into a print position in alignment with said hammer;

carriage control means selectively operable in either a high speed mode for continually moving said carriage means along said line or a lower speed mode for moving said carriage means along said line in steps, stopping at each character position to be printed;

print wheel control means for moving said print wheel means to move a selected one of said characters into said print position prior to said carriage means arriving at each character position to be printed;

carriage interrupt means operable during said high speed mode for stopping the movement of said carriage means at a character position in the event the selected character for that character position fails to move into said print position bythe time said carriage means arrives at that character position;

clock means for supplying a first high speed pulse train and a second lower speed pulse train; and switch means for respectively defining either said high speed mode or said lower speed mode, said switch means including means responsive to said high speed mode for coupling said first pulse train to said carriage control means and to said lower speed mode for coupling said second pulse train to said carriage control means.

3. The printer of claim 2 further including means responsive to said high speed mode for coupling said first pulse train to said print wheel control means and responsive to said lower speed mode for coupling said second pulse train to said print wheel control means.

4. The printer of claim 2 including first and second timing circuits for respectively defining intervals of longer and shorter settling durations;

means responsive to said lower speed mode for coupling said first timing circuit to said carriage control means for inhibiting operation thereof for said longer settling duration; and means responsive to said carriage interrupt means stopping the movement of said carriage means for coupling said second timing circuit to said carriage control means for inhibiting operation thereof for said shorter settling duration.

5. The printer of claim 2 including first and second timing circuits for respectively defining intervals of longer and shorter durations;

means responsive to said lower speed mode for coupling said first timing circuit to said print wheel control means for inhibiting operation thereof for said longer settling duration; and means responsive to said high speed mode for coupling said second timing circuit to said print wheel control means for inhibiting operation thereof for said shorter settling duration.

6. The printer of claim 2 wherein said carriage interrupt means includes carriage sense means for determining the time duration required for said carriage means to reach its destination position i print wheel sense means for determining the time duration required for said print wheel means to move a selected character into said print position; and means for comparing said time durations determined by said carriage sense means and said print wheel sense means.

* * * * *